US010872507B2

(12) United States Patent
Smith et al.

(10) Patent No.: US 10,872,507 B2
(45) Date of Patent: Dec. 22, 2020

(54) SYSTEMS AND METHODS FOR USING TRANSPARENT SURFACES IN AN AUTOMATED TELLER MACHINE

(71) Applicant: Capital One Services, LLC, McLean, VA (US)

(72) Inventors: Robert Smith, Crozier, VA (US); David Wurmfeld, Falls Church, VA (US); Steve Faletti, Brooklyn, NY (US); Celina Liao, San Francisco, CA (US); Janak Dadhaniya, San Francisco, CA (US); Lisa Whitsitt, Millbrae, CA (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 16/748,725

(22) Filed: Jan. 21, 2020

(65) Prior Publication Data

US 2020/0202679 A1 Jun. 25, 2020

Related U.S. Application Data

(63) Continuation of application No. 16/226,621, filed on Dec. 19, 2018, now Pat. No. 10,540,860.

(51) Int. Cl.
*G07F 19/00* (2006.01)

(52) U.S. Cl.
CPC ..... *G07F 19/205* (2013.01); *G07F 19/202* (2013.01); *G07F 19/209* (2013.01)

(58) Field of Classification Search
CPC ..... G07F 19/205
USPC ..... 235/379; 705/39, 43, 45
See application file for complete search history.

(56) References Cited

U.S. PATENT DOCUMENTS

| | | | |
|---|---|---|---|
| 7,793,753 | B2 | 9/2010 | Bernhard et al. |
| 10,540,860 | B1 | 1/2020 | Smith et al. |
| 2005/0205661 | A1 | 9/2005 | Taylor |
| 2006/0249568 | A1 | 11/2006 | Scanlon |
| 2012/0023017 | A1 | 1/2012 | Votaw et al. |
| 2013/0319816 | A1 | 12/2013 | Ross et al. |
| 2015/0363755 | A1 | 12/2015 | Walden et al. |
| 2018/0268398 | A1 | 9/2018 | Park et al. |
| 2019/0066111 | A1 | 2/2019 | Bizarro et al. |
| 2019/0073663 | A1 | 3/2019 | Jamkhedkar et al. |

*Primary Examiner* — Allyson N Trail
(74) *Attorney, Agent, or Firm* — Pillsbury Winthrop Shaw Pittman LLP

(57) ABSTRACT

The present disclosure relates to systems and methods for using transparent surfaces at an automated teller machine. In one implementation, a method of visualizing a deposit at an automated teller machine includes receiving a command to deposit at least one depository element; determining an amount associated with the command; displaying, on a transparent surface of the automated teller machine configured to allow a user of the automated teller machine to view the at least one depository element, a visual representation of the determined amount; and receiving, concurrent with or after displaying, a verification of the amount.

19 Claims, 5 Drawing Sheets

SYSTEMS AND METHODS FOR USING TRANSPARENT SURFACES IN AN AUTOMATED TELLER MACHINE

CROSS-REFERENCE TO RELATED APPLICATIONS

This application is a continuation of U.S. application Ser. No. 16/226,621, filed Dec. 19, 2018. The contents of the above are incorporated herein by reference.

TECHNICAL FIELD

This disclosure relates generally to the field of automated teller machines. More specifically, and without limitation, this disclosure relates to systems and methods for using transparent surfaces in automated teller machines.

BACKGROUND

Automated teller machines (ATMs) often provide deposit capabilities in addition to withdrawal capabilities. However, customer trust in deposits at ATMs is often low because deposits disappear once inserted and are only confirmed using text or graphics on a distinct screen.

Moreover, customer trust in withdrawals suffers from a similar drawback. In particular, withdrawals are dispensed by the ATM, and the customer is tasked with manually counting bills to verify the amount of the withdrawal.

SUMMARY

Disclosed systems and methods for using transparent surfaces in automated teller machines solve the problems associated with traditional automated teller machines. For example, the disclosed systems and methods may allow a customer to visually confirm a deposit or a withdrawal before approval, resulting in increased trust and thus improved experiences.

According to an exemplary embodiment of the present disclosure, a method of visualizing a deposit at an automated teller machine may comprise receiving a command to deposit at least one depository element; determining an amount associated with the command; displaying, on a transparent surface of the automated teller machine configured to allow a user of the automated teller machine to view the at least one depository element, a visual representation of the determined amount; and receiving, concurrent with or after displaying, a verification of the amount.

According to an exemplary embodiment of the present disclosure, a method of visualizing a withdrawal at an automated teller machine may comprise receiving a command to withdraw at least one depository element; determining an amount associated with the command; displaying, on a transparent surface of the automated teller machine configured to allow a user of the automated teller machine to view the at least one depository element, a visual representation of the determined amount; and receiving, concurrent with or after displaying, a verification of the amount.

According to an exemplary embodiment of the present disclosure, an automated teller machine may comprise at least of a one card reader or a contactless device; at least one user input device; at least one slot configured to accept or dispense at least one depository element; at least one transparent surface near the at least one slot and configured to allow a user of the automated teller machine to view the at least one depository element; at least one device configured to display images on the at least one transparent surface; at least one memory storing instructions; and at least one processor configured to execute the instructions to perform operations. The operations may comprise receiving, from the at least one of a card reader or a contactless device, an identifier of the user; authenticating the user using, at least in part, the identifier; receiving, from the at least one input device, a command to accept or dispense one or more depository elements; in response to the command, displaying a visual indicator of an amount associated with the one or more depository elements concurrently with the one or more depository elements being visible to the user through the at least one transparent surface; receiving, from the at least one input device and concurrently with or after displaying, a confirmation of the command; and finalizing the command by accepting or dispensing the one or more depository elements in accordance with the command.

According to an exemplary embodiment of the present disclosure, a method of visualizing a card at an automated teller machine may comprise receiving a card associated with a user; determining an identifier associated with the card; displaying, on a transparent surface of the automated teller machine configured to allow the user to view the card, a visual representation of the determined identifier; and receiving, concurrently with or after displaying, a verification of the identifier.

According to an exemplary embodiment of the present disclosure, a method of visualizing a card at an automated teller machine may comprise receiving a card associated with a user; determining a plurality of accounts associated with the card; displaying, on a transparent surface of the automated teller machine configured to allow the user to view the card, a visual representation of each account; and receiving, concurrently with or after displaying, a selection of one of the accounts.

According to an exemplary embodiment of the present disclosure, an automated teller machine may comprise at least one card reader; at least one transparent surface near the at least one slot and configured to allow a user of the automated teller machine to view a card inserted into the at least one card reader; at least one user input device; at least one memory storing instructions; and at least one processor configured to execute the instructions to perform operations. The operations may comprise receiving, from the at least one card reader, an identifier of the user; determining a plurality of accounts associated with the identifier; displaying, on the at least one transparent surface of the automated teller machine, a visual representation of each account; and receiving, concurrently with or after displaying, a selection of one of the accounts.

Additional embodiments of the present disclosure include non-transitory computer-readable media storing instructions that cause one or more processors to execute any of the methods disclosed herein.

Additional objects and advantages of the present disclosure will be set forth in part in the following detailed description, and in part will be obvious from the description, or may be learned by practice of the present disclosure. The objects and advantages of the present disclosure will be realized and attained by means of the elements and combinations particularly pointed out in the appended claims.

It is to be understood that the foregoing general description and the following detailed description are exemplary and explanatory only, and are not restrictive of the disclosed embodiments.

BRIEF DESCRIPTION OF THE DRAWINGS

The accompanying drawings, which comprise a part of this specification, illustrate several embodiments and, together with the description, serve to explain the disclosed principles. In the drawings.

DETAILED DESCRIPTION

The disclosed embodiments relate to systems and methods for using transparent surfaces on an automated teller machine. Embodiments of the present disclosure may be include one or more such transparent surfaces. Moreover, the automated teller machine may include and/or communicate with one or more general purpose computers. Alternatively or concurrently, the automated teller machine may include and/or communicate with one or more special purpose computers built according to embodiments of the present disclosure using suitable circuit elements, e.g., one or more application-specific integrated circuits or the like.

Figure 1:
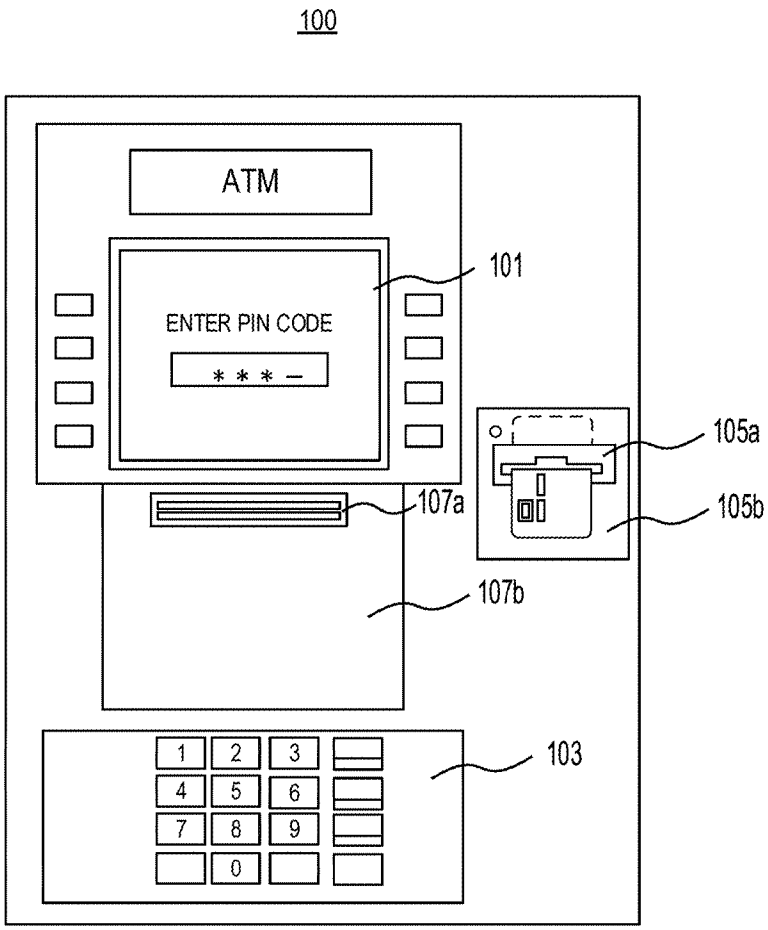
FIG. 1 is a schematic representation of an example automated teller machine, consistent with embodiments of the present disclosure.

FIG. 1 is a schematic representation of example automated teller machine (ATM) 100 having one or more transparent surfaces. ATM 100 may include a screen 101 for displaying messages to a user of ATM 100. Additionally or alternatively, ATM 100 may include a speaker, a haptic motor, or any other mechanism for delivering messages to the user.

As further depicted in FIG. 1, ATM 100 may include a keypad 103 for receiving commands, identifiers, and other input from the user. Additionally or alternatively, ATM 100 may include a touchscreen (e.g., screen 101 may comprise a touchscreen and/or ATM 100 may include a separate touchscreen) or any other mechanism for receiving input from the user.

ATM 100 may further include a card reader 105*a*. For example, card reader 105*a* may comprise a magnetic strip reader, a contactless reader using a near-field communication (NFC) protocol, radio frequency identification (RFID) technology, a Europay, Mastercard and Visa (EMV) standard, or the like. Card reader 105*a* may extract an identifier, such as an account number, from a card inserted into card reader 105*a*. Although depicted as a card reader, element 105*a* may additionally or alternatively comprise a contactless device configured to extract the identifier from a fob, a smartphone, or other external device configured to communicate using contactless technology, such as NFC, RFID, or the like.

Moreover, ATM 100 may further include a transparent surface 105*b* (e.g., a glass surface, a transparent plastic surface, or the like) overlapping, at least in part, card reader 105*a*. Accordingly, as depicted in FIG. 1, a user of ATM 100 may visually see a card after insertion into card reader 105*a*.

ATM 100 may further include one or more slots, such as slot 107*a*. For example, slot 107*a* may accept coins, bills, checks, and other depository elements from a user of ATM 100. Additionally or alternatively, slot 107*a* may output coins, bills, checks, and other depository elements to a user of ATM 100. Slot 107*a* may accept and/or output depository elements using gravity and/or using mechanical means for pushing or pulling the depository elements. For example, ATM 100 may include a conveyor belt, one or more rollers, or the like to move one or more depository elements through slot 107*a*.

Moreover, ATM 100 may further include a transparent surface 107*b* (e.g., a glass surface, a transparent plastic surface, or the like) overlapping, at least in part, slot 107*a*. Accordingly, as depicted in FIG. 1, a user of ATM 100 may visually see the one or more depository elements after insertion into slot 107*a* and/or before ejection from slot 107*a*.

Although not depicted in FIG. 1, transparent surfaces 107*a* and/or 107*b* may be configured to receive a projection (whether front or rear) of one or more graphics, e.g., the graphics explained below with respect to FIGS. 2 and 3. Additionally or alternatively, transparent surfaces 107*a* and/or 107*b* may comprise transparent liquid crystal display (LCD), light emitting diode (LED) display, organic light emitting diode (OLED) display, or the like configured to display the one or more graphics. For example, one or more pixels may be embedded with the glass or other transparent material comprising transparent surfaces 107*a* and/or 107*b* and may activate upon receipt of an electron, light from a backlight, or other activating particle. Accordingly, as used herein, the term "displaying" may refer to an external projection system transmitting light to transparent surfaces 107*a* and/or 107*b* or to the use of an internal or external backlight, transistor, or other source of particles that are transmitted to pixels of transparent surfaces 107*a* and/or 107*b* to activate the pixels.

Figure 2:
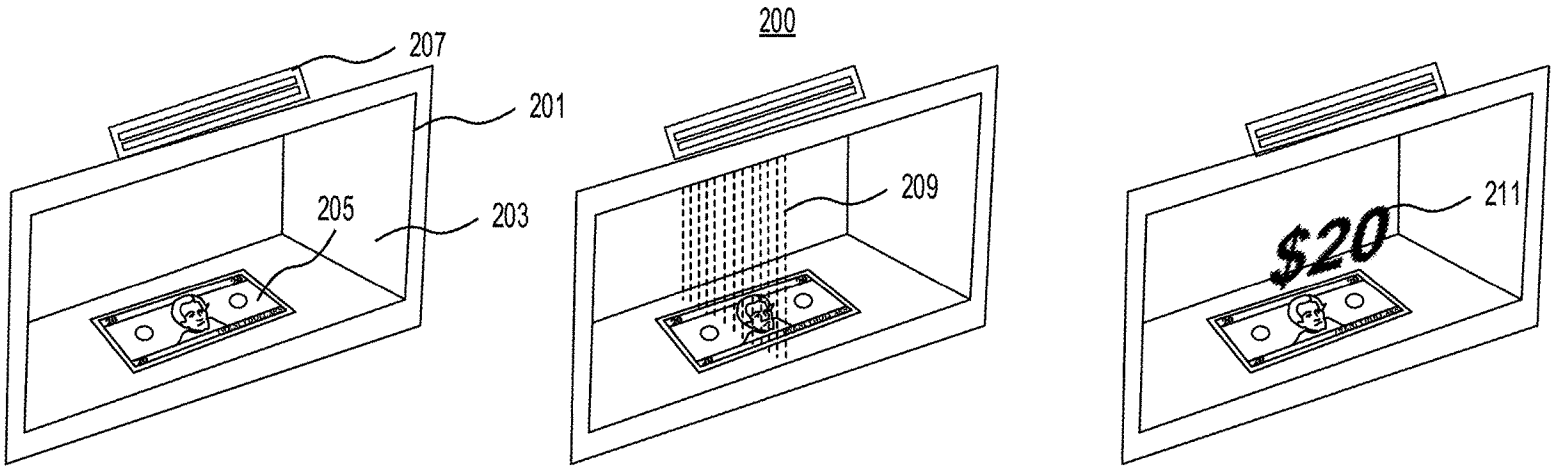
FIG. 2 is a graphical representation of an example visualization for a deposit, consistent with embodiments of the present disclosure.

FIG. 2 depicts an example graphical representation of an visualization used for a deposit at an ATM of the present disclosure. For example, slot 207 of FIG. 2 may comprise slot 107*a* of ATM 100 of FIG. 1, and transparent surface 201 of FIG. 2 may comprise transparent surface 107*b* of ATM 100 of FIG. 1. Although depicted as above transparent surface 201, slot 207 may be below, next to, in the midst of, or near (e.g., within 4", within 3", within 2", within 1", or the like) transparent surface 201.

In the example of FIG. 2, transparent surface 201 covers staging area 203, which may comprise a volume encompassed by walls and transparent surface 201. Although not depicted in FIG. 2, a conveyor belt, one or more rollers, a mechanical arm, or the like may clear staging area 203, e.g., by moving any depository elements in staging area 203 to a volume adjacent to staging area 203 (e.g., a safe, a vault, or other secure storage for depository elements).

Further, in the example of FIG. 2, a user has deposited depository element 205 into staging area 203 via slot 207 (e.g., as explained above with respect to slot 107*a* of ATM 100 of FIG. 1). Although depicted as bills, depository element 205 may additionally or alternatively comprise coins, checks, or the like. Additionally or alternatively, depository element 205 may comprise non-monetary items of value, such as stamps, commemorative coins or medallions, or the like. Accordingly, as used herein, the term "depository element" may refer to any item of value, such as physical currency (e.g., bills and coins), checks, gift cards, stamps or other collectibles, or the like.

In some embodiments, as shown in FIG. 2, a plurality of lights 209 (e.g., lasers, light emitted diodes (LEDs), or the like) may be activated. Lights 209 may be used to scan and determine an amount associated with depository element 205. Alternatively, a scale (e.g., on the bottom of staging area 203), a bill reader (e.g., integrated with slot 207), or the like may determine the amount associated with depository element 205, and lights 209 may be activated for visibility to a user.

Additionally with or alternatively to lights 209, a visual representation 211 of the amount associated with depository element 205 may be displayed on transparent surface 201. Although depicted as text, visual representation 211 may additionally or alternatively comprise graphics of currency in an amount equal to the amount associated with depository element 205. For example, visual representation 211 may comprise graphics of a stack of five $20 bills if the amount associated with depository element 205 is $100. In some embodiments, the type of depository element (e.g., the type of bills, the type of coins, or the like) may match the type of currency of the graphics; alternatively, only the amounts need match.

In embodiments where depository element 205 includes at least one check, visual representation 211 may comprise graphics of one or more checks. Additionally or alternatively, visual representation 211 may comprise text of the amount of one or more checks and/or of issuers of the one or more checks. For example, visual representation 211 may indicate that "Check from Grandma: $5" is being deposited.

In any of the embodiments above, visual representation 211 may be animated. For example, graphics of depository elements may be animated as stacking up. In such an example, a text displaying an amount may increase as the animated graphics stack until the amount displayed by the text matches the amount of depository element 205. In another example, graphics of checks may be animated as transforming into graphics of currency, the graphics of currency optionally having the same amount as the amount of the check(s). In such an example, each check may transform one-by-one until the graphics of currency have the same amount as the amount of the check(s).

Figure 3:
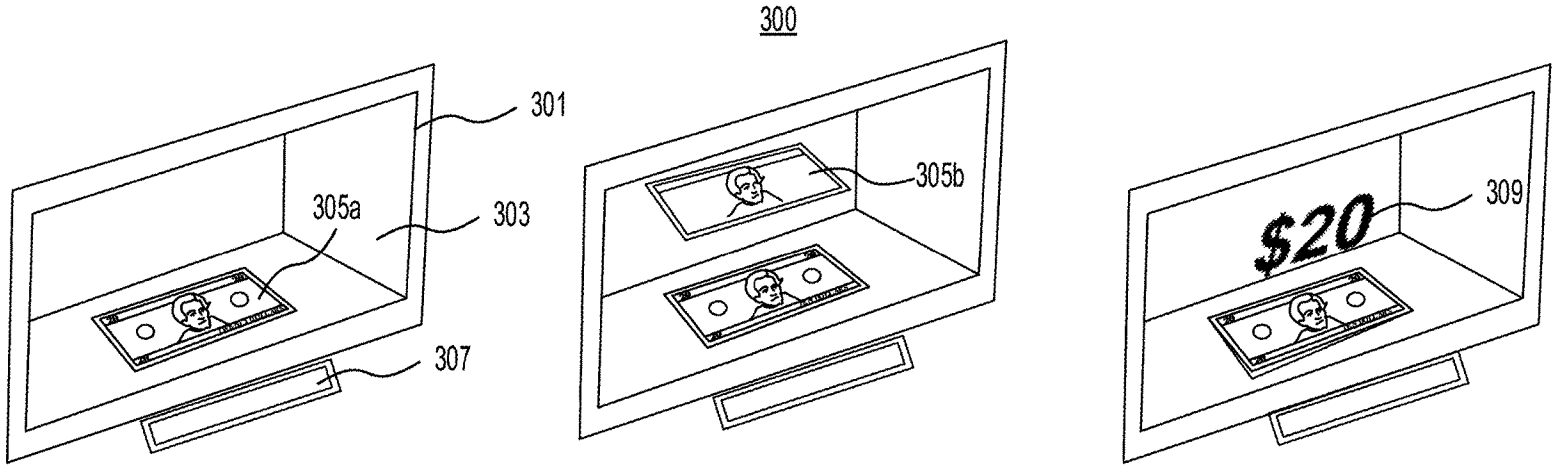
FIG. 3 is a graphical representation of an example visualization for a withdrawal, consistent with embodiments of the present disclosure.

FIG. 3 depicts an example graphical representation of a visualization used for a withdrawal at an ATM of the present disclosure. For example, slot 307 of FIG. 3 may comprise slot 107*a* of ATM 100 of FIG. 1, and transparent surface 301 of FIG. 3 may comprise transparent surface 107*b* of ATM 100 of FIG. 1. Although depicted as above transparent surface 301, slot 307 may be below, next to, in the midst of, or near (e.g., within 4", within 3", within 2", within 1", or the like) transparent surface 301.

In the example of FIG. 3, transparent surface 301 covers staging area 303, which may comprise a volume encompassed by walls and transparent surface 201. Although not depicted in FIG. 2, a conveyor belt, one or more rollers, a mechanical arm, or the like may clear staging area 303, e.g., by moving any depository elements in staging area 303 to a volume adjacent to staging area 303 (e.g., a safe, a vault, or other secure storage for depository elements).

Further, in the example of FIG. 2, the ATM has moved depository element 305*a* into staging area 303, e.g., via a conveyor belt, one or more rollers, a mechanical arm, or the like. Although depicted as bills, depository element 305*a* may additionally or alternatively comprise coins, checks, or the like. In some embodiments, as shown in FIG. 3, depository element 305*b* may be deposited into staging area 303 in a manner such that it stacks or otherwise adds with depository element 305*a* visible to a user of the ATM.

Additionally with or alternatively to moving depository element 305*b* to visibly add with depository element 305*a*, a visual representation 309 of the amount associated with the one or more depository elements (e.g., depository element 305*a* plus depository element 305*b*) may be displayed on transparent surface 301. Although depicted as text, visual representation 309 may additionally or alternatively comprise graphics of currency in an amount equal to the amount associated with depository element 305*a* plus depository element 305*b*. For example, visual representation 309 may comprise graphics of a stack of five $10 bills if the amount associated with depository element 305*a* plus depository element 305*b* is $50. In some embodiments, the type of depository element (e.g., the type of bills, the type of coins, or the like) may match the type of currency of the graphics; alternatively, only the amounts need match.

In embodiments where depository element 305*a* plus depository element 305*b* includes at least one check, visual representation 309 may comprise graphics of one or more checks. Additionally or alternatively, visual representation 309 may comprise text of the amount of one or more checks and/or of issuers of the one or more checks. For example, visual representation 309 may indicate that "Cashier's Check: $5" is being withdrawn.

In any of the embodiments above, visual representation 211 may be animated. For example, graphics of currency may be animated as stacking up. In such an example, a text displaying an amount may increase as the animated graphics stack until the amount displayed by the text matches the amount of depository elements 205. In another example, graphics of checks may be animated as transforming into graphics of currency, the graphics of currency optionally having the same amount as the amount of the check(s). In such an example, each check may transform one-by-one until the graphics of currency have the same amount as the amount of the check(s).

In any of the examples described above, visual representation 211 and/or visual representation 309 may further include an area for confirmation of the amount associated with the one or more depository elements. Accordingly, one or more sensors embedded in transparent surface 201 and/or transparent surface 301, respectively, may recognize input from a user in the area for confirmation and finalize acceptance of the deposit or ejection of the withdrawal, respectively. Additionally or alternatively, one or more sensors embedded in transparent surface 201 and/or transparent surface 301, respectively, may recognize input from a user in an area for rejection included in visual representation 211 and/or visual representation 309, respectively. In response, the ATM may return a deposit to the user and/or return a withdrawal to a safe, vault, or the like, respectively, and instruct the user to complete the transaction at a physical branch rather than the ATM.

Although described above using deposits and withdrawals, similar visual representations may be used for transparent surface 105*b* of ATM 100 of FIG. 1. For example, a visual representation displayed on transparent surface 105*b* may include an identifier of the user based on the card inserted into card reader 105*a* (e.g., "Hello, Greg"). Additionally or alternatively, a visual representation displayed on transparent surface 105*b* may include a list of accounts associated with the card inserted into card reader 105*a* (e.g., "Checking," "Savings," "Investment," or the like). The user may then select one of the accounts similar to the selection of a confirmation or rejection of an amount, as described above.

Figure 4:
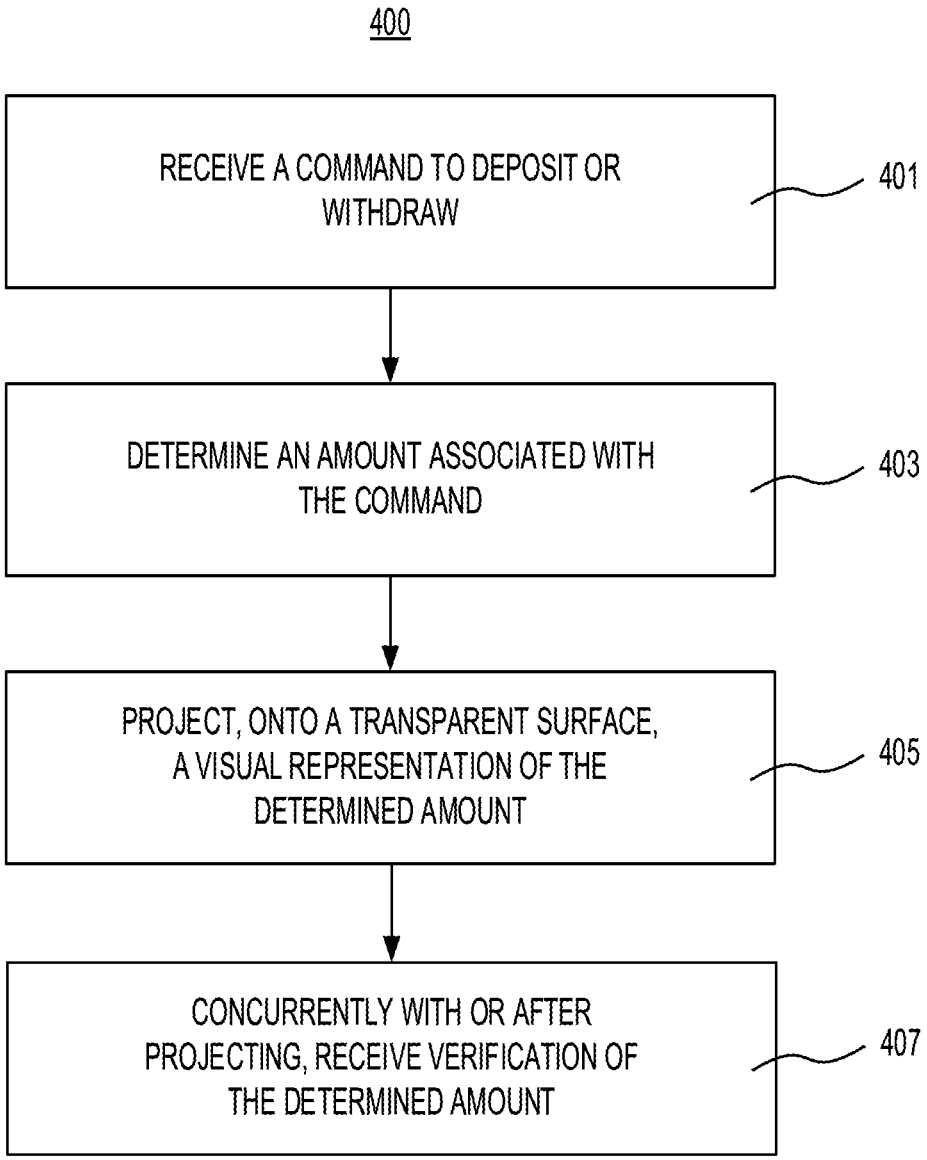
FIG. 4 is a flowchart of an exemplary method for visualizing a deposit on an automated teller machine, consistent with embodiments of the present disclosure.

FIG. 4 is a flowchart of an exemplary method 400 for visualizing a deposit. Exemplary method 400 may be implemented by, for example, ATM 100 of FIG. 1 and/or server 600 of FIG. 6 in communication with ATM 100 of FIG. 1. Exemplary method 400 may further be implemented using a general purpose computer or special purpose computer having at least one processor.

At step 401, the ATM (or a processor thereof) may receive a command to deposit and/or a command to withdraw at least one depository element. For example, the command may be received from a user of the automated teller machine. In such an example, the command may comprise a selection, by the user, of an option on an input device (e.g., keypad 103 of ATM 100 of FIG. 1, touchscreen 101 of ATM 100 of FIG. 1, or the like) of the automated teller machine.

In some embodiments, step 401 may further include receiving, from at least one card reader, an identifier of the user; authenticating the user using, at least in part, the identifier; and receiving, from the at least one input device, the command to accept or dispense one or more depository elements (e.g., currency such as bills or coins, checks, or the like). For example, card reader 105*a* may receive a card and extract an account number or other identifier from the card, as explained above with respect to FIG. 1. Moreover, the ATM (or a processor thereof) may authenticate that the identifier of the user is valid, e.g., by extracting another piece of data from the card (such as an identifier of the card) and comparing it to known data associated with the identifier of the user. In some embodiments, the ATM (or a processor thereof) may transmit the piece of data from the card with the identifier of the user to a remote server for the comparison.

At step 403, the ATM (or a processor thereof) may determine an amount associated with the command. For example, determining the amount may comprise receiving the amount as input from a user of the automated teller machine. For example, the input may comprise a number corresponding to the amount received, from a user, at an input device (e.g., keypad 103 of ATM 100 of FIG. 1, touchscreen 101 of ATM 100 of FIG. 1, or the like) of the automated teller.

At step 405, the ATM (or a processor thereof) may display, on a transparent surface (e.g., transparent surface 107*b* of ATM 100 of FIG. 1) of the automated teller machine, a visual representation of the determined amount. For example, displaying the visual representation may comprise sending a command to a projector of the automated teller machine configured to project the visual representation on a front side or a back side of the transparent surface. Additionally or alternatively, displaying the visual representation may comprise sending a command to at least one of a liquid crystal display (LCD) or a light-emitting diode (LED) array embedded in the transparent surface to display the visual representation.

As explained above with respect to FIGS. 1, 2, and 3, the transparent surface may be configured to allow a user of the automated teller machine to view the at least one depository element. Accordingly, the visual representation may overlap, at least in part, the at least one depository element.

As further explained above with respect to FIGS. 2 and 3, the visual representation may comprise text indicating the amount and/or graphics of currency corresponding to the amount. Additionally or alternatively, the visual representation may be animated as explained above with respect to FIGS. 2 and 3.

At step 407, the ATM (or a processor thereof) may, concurrently with or after displaying, receive a verification of the amount. For example, the verification may be received, from a user, at an input device (e.g., keypad 103 of ATM 100 of FIG. 1, touchscreen 101 of ATM 100 of FIG. 1, or the like) of the automated teller. Additionally or alternatively, the verification may be received using one or more sensors embedded in the transparent surface (e.g., transparent surface 107*b* of ATM 100 of FIG. 1) of the automated teller machine, as explained above with respect to FIGS. 2 and 3. Indeed, any of the embodiments above, any or all of the input may be entered using the transparent surface.

Method 400 may further include additional steps. For example, if the command comprises a withdrawal, method 400 may further include dispensing the physical currency or other depository elements after receiving the verification. Similarly, if the command comprises a deposit, method 400 may further include moving the physical currency or other depository elements to at least one of a safe or a vault after receiving the verification. Thus, method 400 may include finalizing the command by accepting or dispensing the one or more depository elements (e.g., currency such as bills or coins, checks, or the like) in accordance with the command.

Figure 5:
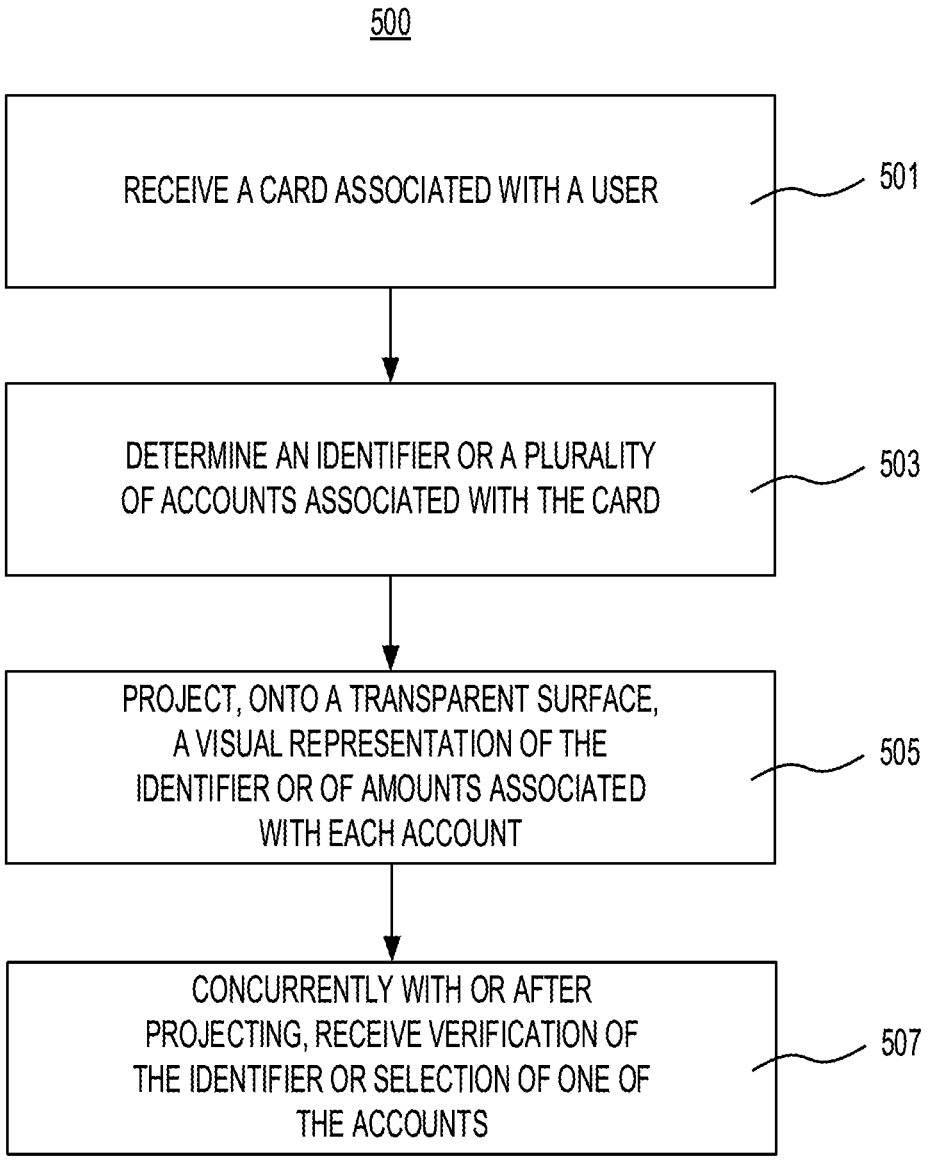
FIG. 5 is a flowchart of an exemplary method for visualizing a withdrawal on an automated teller machine, consistent with embodiments of the present disclosure.

FIG. 5 is a flowchart of an exemplary method 500 for visualizing a withdrawal. Exemplary method 500 may be implemented by, for example, ATM 100 of FIG. 1 and/or server 600 of FIG. 6 in communication with ATM 100 of FIG. 1. Exemplary method 500 may further be implemented using a general purpose computer or special purpose computer having at least one processor.

At step 501, the ATM (or a processor thereof) may receive a card associated with a user. For example, card reader 105*a* may receive a card and extract an account number or other identifier from the card, as explained above with respect to FIG. 1.

At step 503, the ATM (or a processor thereof) may determine an identifier associated with the card and/or a plurality of accounts associated with the card. For example, the ATM (or a processor thereof) may receive the identifier from at least one card reader (e.g., card reader 105*a* of ATM 100 of FIG. 1) receiving the card. Additionally or alternatively, the ATM (or a processor thereof) may transmit data extracted from the card to a remote server and receive the identifier and/or the plurality of accounts from the remote server.

Moreover, the ATM (or a processor thereof) may authenticate that the identifier of the user is valid, e.g., by extracting another piece of data from the card (such as an identifier of the card) and comparing it to known data associated with the identifier of the user. In some embodiments, the ATM (or a processor thereof) may transmit the piece of data from the card with the identifier of the user to the remote server for the comparison.

At step 505, the ATM (or a processor thereof) may display, on a transparent surface (e.g., transparent surface 105*b* of ATM 100 of FIG. 1) of the automated teller machine, a visual representation of the determined identifier and/or of each account. For example, displaying the visual representation may comprise sending a command to a projector of the automated teller machine configured to project the visual representation on a front side or a back side of the transparent surface. Additionally or alternatively, displaying the visual representation may comprise sending a command to at least one of a liquid crystal display (LCD) or a light-emitting diode (LED) array embedded in the transparent surface to display the visual representation.

As explained above with respect to FIGS. 1, 2, and 3, the transparent surface may be configured to allow a user of the automated teller machine to view the card. Accordingly, the visual representation may overlap, at least in part, the received card.

As further explained above with respect to FIGS. 2 and 3, the visual representation may comprise text indicating an identifier (e.g., a name or the like) of the user and/or identifiers (e.g., names, partial account numbers, or the like) of each account. Additionally or alternatively, the visual representation may be animated as explained above with respect to FIGS. 2 and 3.

At step 507, concurrently with or after displaying, the ATM (or a processor thereof) may receive a verification of the identifier and/or a selection of one of the accounts. For example, the verification and/or selection may be received, from a user, at an input device (e.g., keypad 103 of ATM 100 of FIG. 1, touchscreen 101 of ATM 100 of FIG. 1, or the like) of the automated teller. Additionally or alternatively, the verification and/or selection may be received using one or more sensors embedded in the transparent surface (e.g., transparent surface 107*b* of ATM 100 of FIG. 1) of the automated teller machine, as explained above with respect to FIGS. 2 and 3. Indeed, any of the embodiments above, any or all of the input may be entered using the transparent surface.

Method 500 may further include additional steps. For example, after verification and/or after selection of the account, method 500 may proceed to process a withdrawal command and/or a deposit command, e.g., in accordance with method 400 of FIG. 4, described above.

Figure 6:
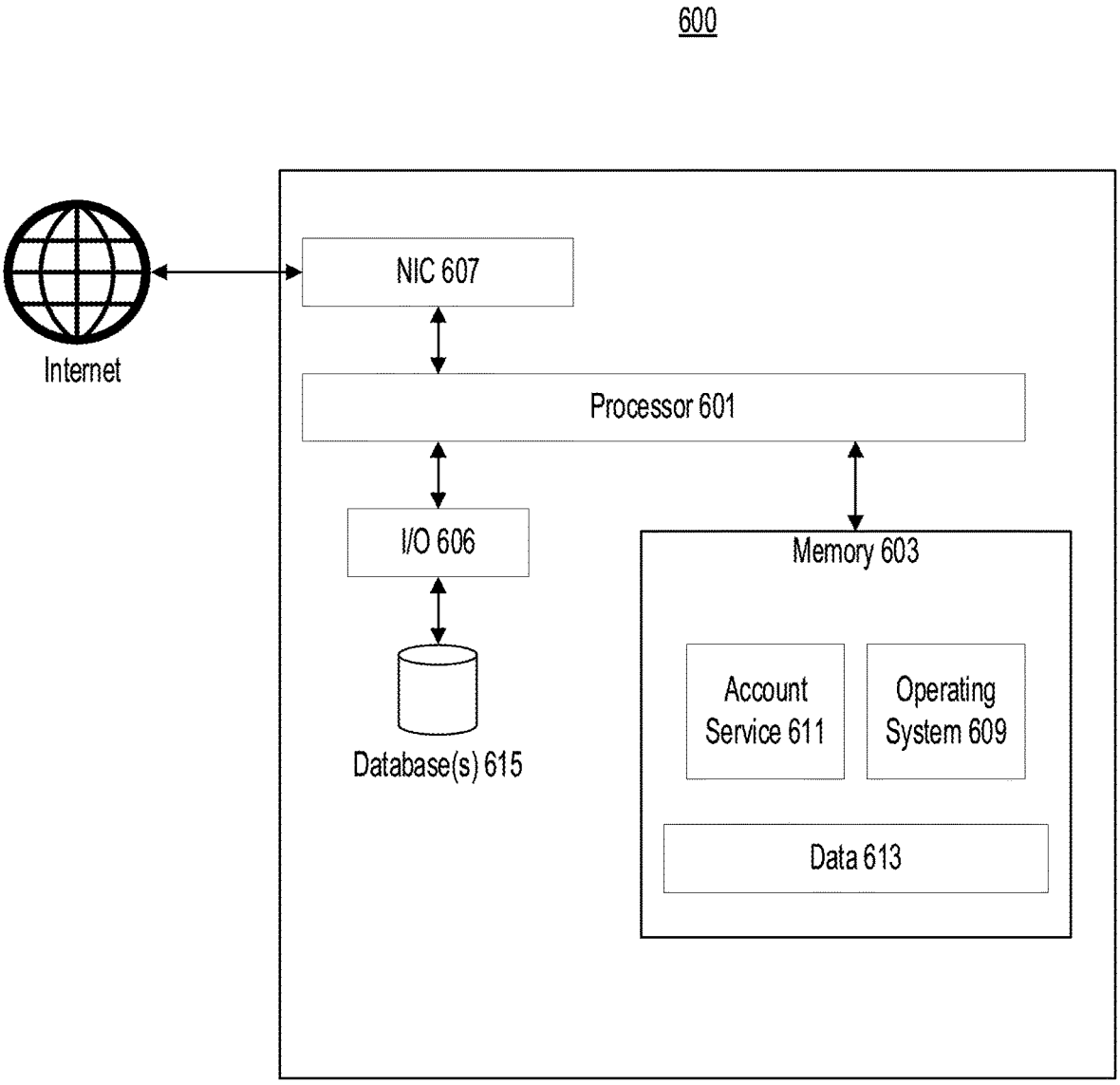
FIG. 6 is a depiction of an exemplary server for executing methods consistent with the present disclosure.

FIG. 6 is a depiction of an example server 600 for processing a withdrawal or a deposit from an automated teller machine (ATM) of the present disclosure. Server 600 of FIG. 6 may therefore be in communication with ATM 100 of FIG. 1. As depicted in FIG. 6, server 600 may have a processor 601. Processor 601 may comprise a single processor or a plurality of processors. For example, processor 601 may comprise a CPU, a GPU, a reconfigurable array (e.g., an FPGA or other ASIC), or the like.

Processor 601 may be in operable connection with a memory 603, an input/output module 605, and a network interface controller (NIC) 607. Memory 603 may comprise a single memory or a plurality of memories. In addition, memory 603 may comprise volatile memory, non-volatile memory, or a combination thereof. As depicted in FIG. 6, memory 603 may store one or more operating systems 609 and a account service 611. For example, account service 611 may include instructions to update account records in accordance with a deposit according to method 400 of FIG. 4 and/or a withdrawal according to method 500 of FIG. 5.

Input/output module 605 may store and retrieve data from one or more databases 615. For example, database(s) 615 may include one or more account records updated by account service 611. Accordingly, database(s) 615 may be encrypted.

NIC 607 may connect server 600 to one or more computer networks. In the example of FIG. 6, NIC 607 connects server 600 to the Internet. Server 600 may receive data and instructions over a network using NIC 607 and may transmit data and instructions over a network using NIC 607. Moreover, server 600 may receive requests from devices associated with customers over a network using NIC 607, as described above.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, the described implementations include hardware and software, but systems and methods consistent with the present disclosure can be implemented with hardware alone. In addition, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

Instructions or operational steps stored by a computer-readable medium may be in the form of computer programs, program modules, or codes. As described herein, computer programs, program modules, and code based on the written description of this specification, such as those used by the controller, are readily within the purview of a software developer. The computer programs, program modules, or code can be created using a variety of programming techniques. For example, they can be designed in or by means of Java, C, C++, assembly language, or any such programming languages. One or more of such programs, modules, or code can be integrated into a device system or existing communications software. The programs, modules, or code can also be implemented or replicated as firmware or circuit logic.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A method comprising:

receiving a currency deposit at an automated teller machine;

determining an amount of the currency deposit; and displaying, on a transparent surface of the automated teller machine, a visual representation of the determined amount of the currency deposit, wherein the currency deposit is visible through the transparent surface as the visual representation of the determined amount of the currency deposit is displayed on the transparent surface.

2. The method of claim 1, wherein the currency deposit is received from a user of the automated teller machine.

3. The method of claim 1, wherein determining the amount comprises receiving the amount as input from a user of the automated teller machine.

4. The method of claim 3, wherein the input comprises a number corresponding to the amount received, from the user, at an input device of the automated teller machine.

5. The method of claim 1, wherein displaying the visual representation comprises sending a command to a projector of the automated teller machine configured to project the visual representation on a front side or a back side of the transparent surface.

6. The method of claim 1, wherein displaying the visual representation comprises sending a command to at least one of a liquid crystal display (LCD) or a light-emitting diode (LED) array embedded in the transparent surface to display the visual representation.

7. The method of claim 1, wherein the visual representation comprises text indicating the amount.

8. The method of claim 1, wherein the visual representation comprises graphics of currency corresponding to the amount.

9. The method of claim 1, wherein the visual representation overlaps, at least in part, at least one depository element of the currency deposit.

10. A method comprising:

receiving, at an automated teller machine, a command to dispense currency;

determining an amount of currency to dispense based on the command; and displaying, on a transparent surface of the automated teller machine, a visual representation of the determined amount of currency, wherein the currency to be dispensed is visible through the transparent surface as the visual representation of the determined amount of currency is displayed on the transparent surface.

11. The method of claim 10, wherein displaying the visual representation comprises sending a command to a projector of the automated teller machine configured to project the visual representation on a front side or a back side of the transparent surface.

12. The method of claim 10, wherein displaying the visual representation comprises sending a command to at least one of a liquid crystal display (LCD) or a light: emitting diode (LED) array embedded in the transparent surface to display the visual representation.

13. The method of claim 10, further comprising receiving, concurrent with or after displaying, a verification of the amount.

14. The method of claim 13, wherein the verification is received as input from a user of the automated teller machine at the transparent surface.

15. The method of claim 10, wherein the visual representation comprises at least one of text indicating the amount or graphics of currency corresponding to the amount.

16. A system, comprising:

at least one of a contactless reader or a card reader;

at least one user input device;

at least one slot configured to accept or dispense currency;

at least one transparent surface near the at least one slot, wherein the currency is visible through the transparent surface;

at least one device configured to display images on the at least one transparent surface;

at least one memory storing instructions; and at least one processor configured to execute the instructions to perform operations comprising:

receiving, from the at least one of the card reader or the contactless reader, an identifier of a user; and authenticating the user based on the identifier.

17. The system of claim 16, further comprising:

a projector configured to project a visual representation on a front side or a back side of the transparent surface.

18. The system of claim 16, wherein the at least one device configured to display images on the at least one transparent surface is a liquid crystal display.

19. The system of claim 16, wherein the at least one device configured to display images on the at least one transparent surface is a light-emitting diode (LED) array.

* * * * *